United States Patent [19]

Garrett et al.

[11] 4,003,434

[45] Jan. 18, 1977

[54] METHOD AND APPARATUS FOR RUNNING, OPERATING, AND RETRIEVING SUBSEA WELL EQUIPMENT

[75] Inventors: Michael R. Garrett; Michael J. Krenek, both of Houston, Tex.

[73] Assignee: FMC Corporation, San Jose, Calif.

[22] Filed: July 25, 1975

[21] Appl. No.: 599,141

[52] U.S. Cl. ..... 166/315; 166/.5; 166/120; 166/136; 166/212; 285/141

[51] Int. Cl.[2] ..... E21B 23/00; E21B 23/04

[58] Field of Search ..... 166/.5, 120, 212, 315, 166/136, 123, 125, 214, 206, 207; 285/DIG. 21, 18, 141, 138

[56] References Cited

UNITED STATES PATENTS

| | | | |
|---|---|---|---|
| 2,695,064 | 11/1954 | Ragan et al. | 166/120 |
| 3,002,561 | 10/1961 | Baker et al. | 166/120 |
| 3,086,590 | 4/1963 | Jackson et al. | 166/.6 |
| 3,098,525 | 7/1963 | Haeber | 285/DIG. 21 |
| 3,098,525 | 7/1963 | Haeber | 166/.6 |
| 3,177,703 | 4/1965 | Waters et al. | 166/.6 |
| 3,223,169 | 12/1965 | Roark | 166/120 |
| 3,321,217 | 5/1967 | Ahlstone | 166/.6 |
| 3,412,801 | 11/1968 | Young | 166/120 |
| 3,924,678 | 12/1975 | Ahlstone | 166/120 |

*Primary Examiner*—Stephen J. Novosad
*Attorney, Agent, or Firm*—W. W. Ritt, Jr.; C. E. Tripp

[57] ABSTRACT

A method and apparatus for running, operating, and retrieving packoffs, bowl protectors, casing heads, casing hangers, and other well tools employed in drilling and completing subsea wells. Broadly considered, the method involves running the well tool and a special running and retrieving tool to which it is releasably connected into the well by means of a drill or other pipe string and then pressurizing the wellhead through the choke and kill lines to actuate the running and retrieving tool and release it from the well tool for subsequent retrieval and re-use. Various embodiments of the running and retrieving tool are described.

8 Claims, 9 Drawing Figures

METHOD AND APPARATUS FOR RUNNING, OPERATING, AND RETRIEVING SUBSEA WELL EQUIPMENT

BACKGROUND OF THE INVENTION

This invention relates to methods and apparatus for running, operating, and retrieving devices used in drilling and completing wells at an underwater location. More particularly, the invention relates to hydraulically actuated tools for running, operating, and retrieving various subsea well completion equipment such as packoffs, bowl protectors, casing heads, and casing hangers, and to methods for actuating these tools. United States patents on these subjects can be found in class 166 of the United States Patent Classification System.

Prior to the present invention, in the process of drilling and completing subsea oil and gas wells it has been conventional practice to employ external hydraulic lines or the inner bore of the drill pipe string to conduct hydraulic control fluid from the drilling vessel or platform to the subsea wellhead for actuating various well tools at that remote location. Although external hydraulic lines are generally successful these lines are cumbersome, they are easily damaged, their cost is significant, and their use usually requires a separate source of power and controls therefor. Using the bore of the drill string also is not considered desirable, especially because of the time involved in installing the kelly assembly. Furthermore, when the drill string is employed for this purpose it must be plugged at the bottom, and this prevents the hydraulic fluid from draining as the string is broken apat during retrieval from the well, with the result that the hydraulic fluid spills onto the work area. Although retrievable plugs can be used in the drill string, such use requires an extra, and of course costly, trip into and out of the well to retrieve the plug.

SUMMARY OF THE INVENTION

Broadly considered, the present invention involves the use of the choke and kill lines to conduct hydraulic pressure from the surface to a subsea or other remotely located wellhead for actuating a special hydraulically operated running and retrieving tool that is employed to releasably interconnect a well tool such as for example, a packoff, a bowl protector, a casing head, and a casing hanger, to a drill string or other pipe string on which this equipment is run into the well. In carrying out the method of this invention, after the well tool has been run into the wellhead the blowout preventer stack is closed around the running string, and the wellhead is then pressurized through the choke and kill lines. This pressure actuates a hydraulic piston or other hydraulically responsive element on the running and retrieving tool to release it from the well tool, whereupon the running and retrieving tool can be retrieved by lifting straight up on the running string and withdrawing it from the well.

One embodiment of running and retrieving tool according to the present invention has a split contractible lock ring that functions to releasably secure this tool to the well tool that is being run into or retrieved from the well. Application of hydraulic pressure against an annular piston on the running and retrieving tool causes the piston to contract the lock ring inwardly into an annular recess in the tool body, thereby releasing the running and retrieving tool from the well tool, and facilitating its withdrawal from the well tool and the well by simply lifting on the running string.

Another embodiment of running and retrieving tool according to this invention employs a plurality of lock pistons in lieu of the lock ring to interconnect the tool with a well tool, these lock pistons preferably being spaced circumferentially about the running and retrieving tool body and being spring-biased in an outward or locking direction. The lock pistons are disengaged from the well tool, thereby unlocking or releasing the running and retrieving tool from said well tool, also by pressurizing the wellhead through the choke and kill lines.

The various embodiments of the running and retrieving tool of the present invention can be employed not only to run and/or retrieve well tools into and from a subsea wellhead, they also can be employed to operate the well tools, such as setting a compression-type packoff in the wellhead, if desired.

Accordingly, one object of the present invention is to provide a new method and apparatus for running, operating, and retrieving subsea well tools.

Another object of the present invention is to provide an improved method and apparatus for hydraulically operating subsea well tools without the need for auxiliary hydraulic lines.

Another object of the present invention is to provide an improved method and apparatus for hydraulic operation of remote well tools without employing a drill string, or other pipe string, as a conduit for the hydraulic pressure.

Still another object of the present invention is to provide a new type of hydraulically operated running and retrieving tool for use in drilling and completion activities in subsea wells.

Still another object of the present invention is to provide a more efficient method and apparatus for running and retrieving well tools from a remotely located wellhead.

DESCRIPTION OF THE PREFERRED EMBODIMENT

Figure 1:
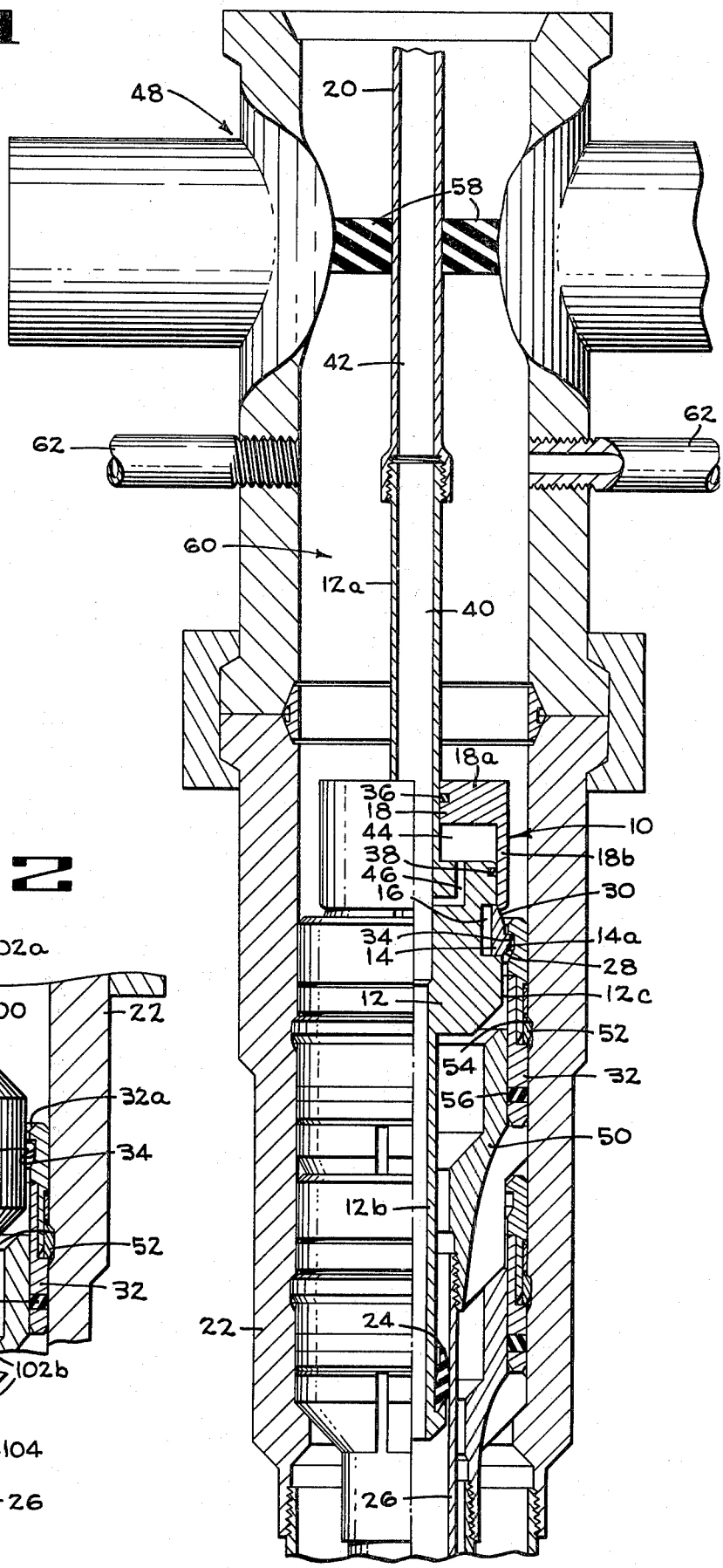
FIG. 1 is an elevation, partially in section, diagrammatically illustrating a subsea wellhead, a blowout preventer mounted on the wellhead, and one embodiment of running and retrieving tool according to the present invention attached to a drill string and releasably connected to a packoff between the wellhead and the casing hanger of the innermost casing string.

Referring first to FIG. 1, a hydraulically actuated running and retrieving tool according to the present invention is diagrammatically illustrated at 10, and comprises a generally annular body 12, an axially-split, contractible lock ring 14 carried by the body 12 in an external annular groove 16, and an annular piston 18 surrounding the portion of the body 12 above the lock ring 14. The body 12 has an upwardly extending central tubular portion 12*a* that is threaded at its upper end for attaching the tool 10 to a drill string or other pipe string 20 that is employed to run and retrieve the tool into and from a subsea wellhead 22. The tool body 12 also has a downwardly extending central tubular portion 12*b* for supporting an annular flexible seal element 24 that provides a fluid-tight barrier in the annulus between the tubular portion 12*b* and a casing string 26 when the tool 10 is properly positioned in the wellhead 22, as shown in FIG. 1.

The lock ring 14 is somewhat L-shaped in cross-section, having a radially outwardly projecting portion 14*a*, an outwardly and upwardly sloping lower cam surface 28, and an inwardly and upwardly sloping upper cam surface 30. In the lock ring's expanded condition as illustrated in FIG. 1, the portion 14*a* projects a significant distance beyond the outer annular surface 12*c* of the tool body 12. When, as shown in FIG. 1, the running and retrieving tool 10 is properly connected to a well tool such as a compression-type packoff diagrammatically illustrated at 32, the lock ring 14 protrudes into an inner annular groove in the well tool, such as the groove 34 near the upper end of the packoff 32, thereby releasably securing the packoff 32 or other well tool to the running and retrieving tool 10 so that they can be run into and/or retrieved from the wellhead 22 as an assembly.

The annular piston 18 of the running and retrieving tool 10 includes a body 18*a* that surrounds the tool's upper tubular portion 12*a*, and a skirt 18*b* that extends downwardly from the outer edge of the body 18*a* to surround the upper area of the tool body 12. The piston 18 is slidable axially with respect to the tool body 12, and is dynamically sealed thereto by annular seal elements 36,38. As the piston 18 moves downwardly with respect to the tool body 12, the lower inner edge of the skirt 18*b* bears against the lock ring cam surface 30, thereby camming the ring inwardly into the groove 16 and withdrawing the ring from engagement with the packoff 32.

A central longitudinal bore 40 extends through the tool 10 and is continuous with a bore 42 in the running string 20. The piston 18 and the body 12 of the tool 10 form an annular chamber 44, and this chamber is vented to the bore 40 by a passage 46 to relieve pressure in the chamber as the piston moves downwardly, and also of course to facilitate returning the piston to its uppermost postion as shown in FIG. 1.

When employing the running and retrieving tool 10 to run the packoff 32 or other well tool into the wellhead 22, which wellhead is surmounted by a blowout preventer system diagrammatically illustrated at 48, the packoff is releasably connected to the tool 10 at the drilling platform or vessel by means of the lock ring 14. The tool 10 and the packoff 32 are then run as an assembly into the wellhead 22, the packoff is landed as on a fluted casing hanger 50, locked to the wellhead by expanding the packoff's split lock ring 52 into a wellhead groove 54, and the packoff's annular resilient seal element 56 compressed axially until it establishes the desired fluid-tight barrier between the wellhead and the casing hanger 50. The blowout preventer rams 58 are then closed around the running string 20, and hydraulic pressure is applied to the wellhead interior 60 through the choke and kill lines diagrammatically represented at 62. Since the wellhead interior 60 is sealed off by the running and retrieving tool seal element 24, the packoff seal element 56, and the blowout preventer rams 58, the differential pressure between the wellhead interior and the bore 42 of the running string 20 forces the running and retrieving tool piston 18 downwardly, thereby contracting the tool lock ring 14 and releasing the tool from the packoff 32. The wellhead interior 60 then can be depressurized, as by releasing the hydraulic pressure in the choke and kill lines 62, the blowout preventer rams 58 opened, and the tool 10 retrieved from the wellhead by withdrawal of the running string 20.

When the running and retrieving tool 10 is used to retrieve the packoff 32 or other well tool from a wellhead such as 22, the tool 10 with the piston 18 in its upper position, i.e., as in FIG. 1 wherein the lock ring 14 is in its expanded condition, is run on the running string 20 into the wellhead and the packoff until the lock ring 14 is opposite the packoff groove 34. As the lock ring 14 moves downwardly through the top of the packoff, the lower cam surface 28 of the lock ring engages the packoff whereby the ring is caused to contract into the tool groove 16. When the lock ring 14 reaches the packoff groove 34 it expands into this groove, thereby interconnecting the packoff and the tool 10 for subsequent retrieval as an assembly simply by withdrawing the running string 20 from the well.

Figure 2:
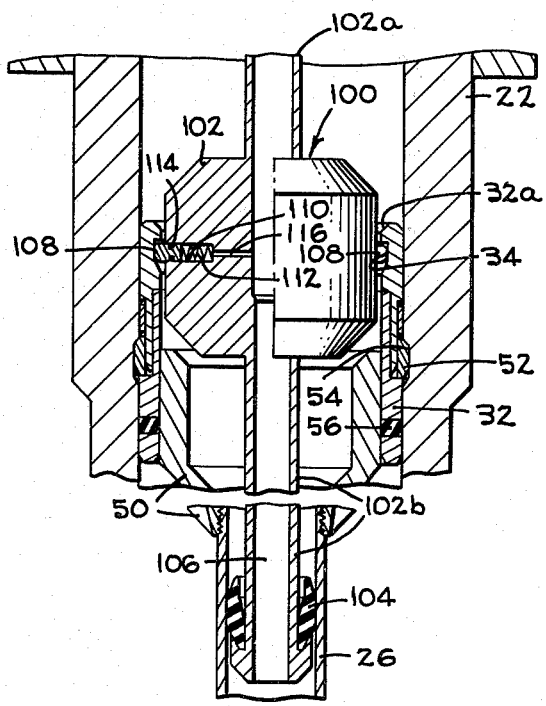
FIG. 2 is a fragmentary view of the wellhead of FIG. 1 showing a modification of the running and retrieving tool.

When the present invention is to be employed for running, operating, and/or retrieving a packoff or other well tool having well-known "J" slot connecting means, a modified version of running and retrieving tool 100, illustrated diagrammatically in FIG. 2, can be used. This tool 100 comprises a body 102 with upper and lower central tubular portions 102*a*,102*b*, an annular seal element 104 on the lower tubular portion 102*b*, and a central bore 106, all functionally equivalent to their counterparts 12*a*, 12*b*, 24, and 40, respectively, in the tool 10 of FIG. 1. However, instead of a split lock ring, the tool 100 has a plurality of circumferentially spaced lock pistons 108 disposed in individual lateral chambers 110 (only one shown) in the body 102, and each lock piston is biased outwardly into the packoff groove 34 by a coil spring 112 (only one shown). Each lock piston 108 is dynamically sealed to its chamber 110 by an annular seal element 114 (only one shown), and each chamber is vented to the tool bore 106 by a passage 116 (only one shown).

Accordingly, when the wellhead 22 is pressurized through the choke and kill lines 62 (FIG. 1), the lock pistons 108 are forced inwardly towards the tool bore 106 and out of the packoff groove 34, thereby releasing the tool 100 from the packoff for subsequent retrieval from the well.

The coil springs 112 of the running and retrieving tool 100 (FIG. 2) that bias the lock pistons 108 outwardly also permit the lock pistons to move inwardly as the tool is being inserted into the packoff 32, that is in response to the camming action of the packoff's upper inner annular cam surface 32*a*. Accordingly, this tool 100 eliminates the need to rotate the running string in order to locate the entrance to the "J" slot in the packoff or other well tool when connecting the tool 100 to these well tools.

Because of their through bores 40 and 106, both the running and retrieving tool 10 and its modified version 100 are completely pressure balanced while being run into or retrieved from a well. Thus they do not have a tendency to be pumped out of the well, and of course they do not pressure up the entire casing string, during their operation.

Figure 3:
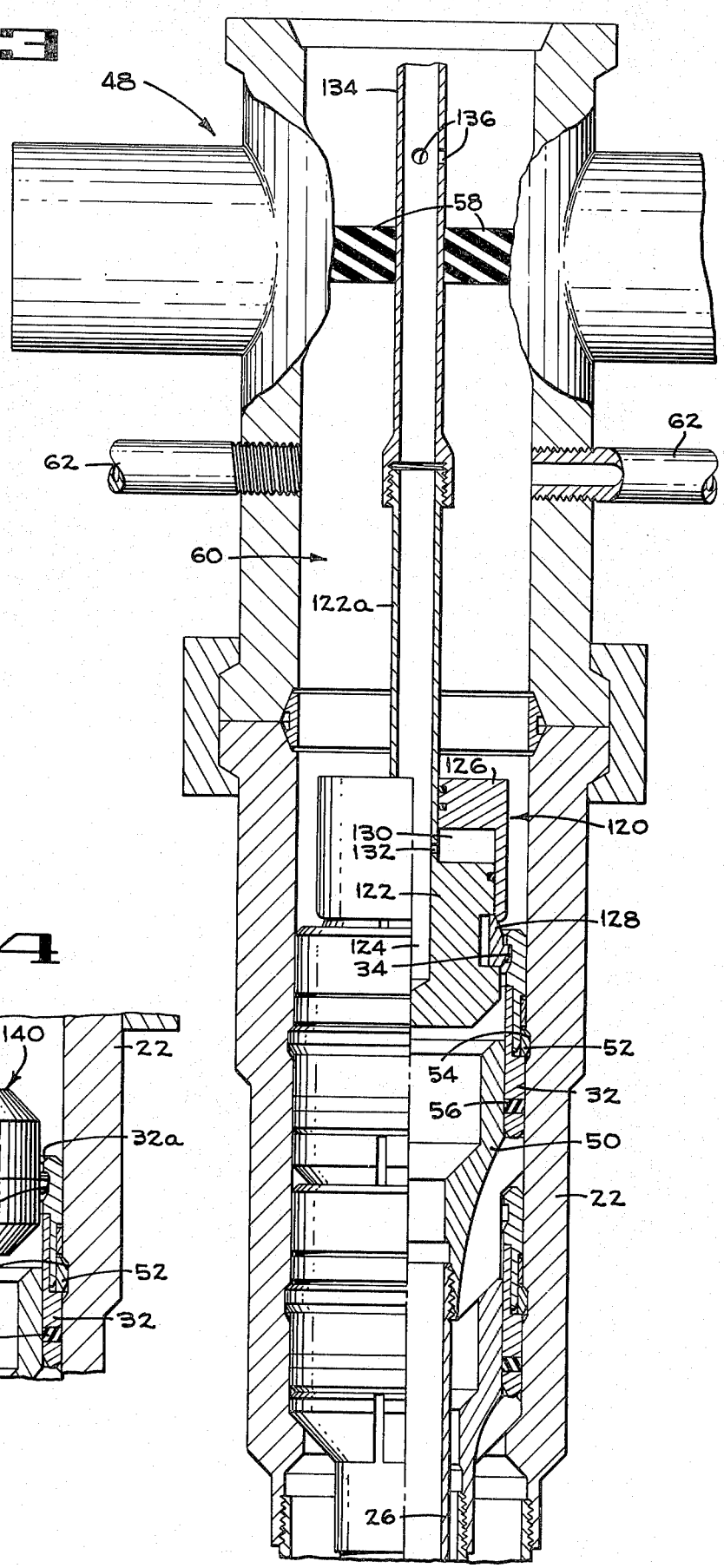
FIG. 3 is a view like FIG. 1, illustrating another embodiment of running and retrieving tool according to the present invention.

The running and retrieving tool diagrammatically illustrated at 120 in FIG. 3 is identical in most respects to the tool 10 of FIG. 1, the difference being that the tool body 122 is closed at its lower end so that its bore 124 terminates within the body 122 instead of extending entirely through it. Otherwise the tool 120 has a piston 126, a lock ring 128, and an upper central tubular portion 122*a* that are functional equivalent to their counterparts 18,14, and 12*a*, respectively, of the tool 10. The chamber 130 is vented to the tool bore 124 by one or more passages 132, and pressure balancing is accomplished by perforations or ports 136 in the drill string 134 above the blowout preventer 48. Thus, it should be evident that the tools 10 and 120 function generally in the same manner with respect to their operation during running and retrieving well tools into and from a remotely located wellhead.

Figure 4:
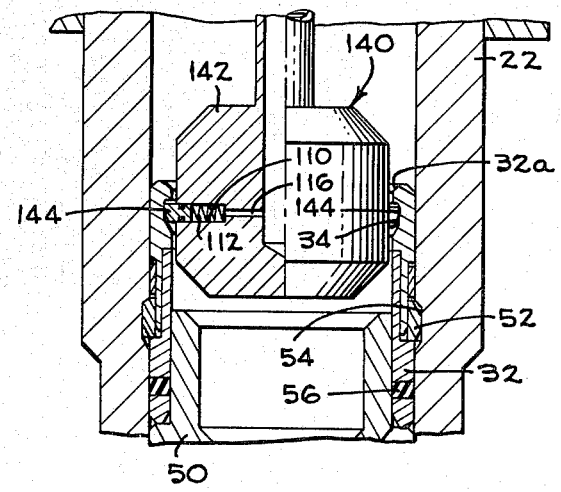
FIG. 4 is a view like FIG. 2, showing a modification of the running and retrieving tool illustrated in FIG. 3.

The running and retrieving tool 140 shown in FIG. 4 is a modified version of the tool 120 of FIG. 3, having a body 142 with sprinng-biased lock pistons 144 that are employed in lieu of the lock ring 128 to interconnect the tool 140 with a packoff 32 or other well tool. Thus, this tool 140 functions in the same way as the tool 100 of FIG. 2, yet is pressure balanced in the manner of tool 120 of FIG. 3.

As should be readily apparent, both running and retrieving tools 120,140 may be modified by the provision of a seal or packing element, such as 24 of FIG. 1, to seal them to the casing 26 where pressuring up the entire casing string is not desirable. Such a seal could be mounted, for example, on a cylindrical downward extension of the tool bodies 122,142, much like the lower central tubular portion 12*b* of FIG. 1, but without, of course, a bore.

Figure 5:
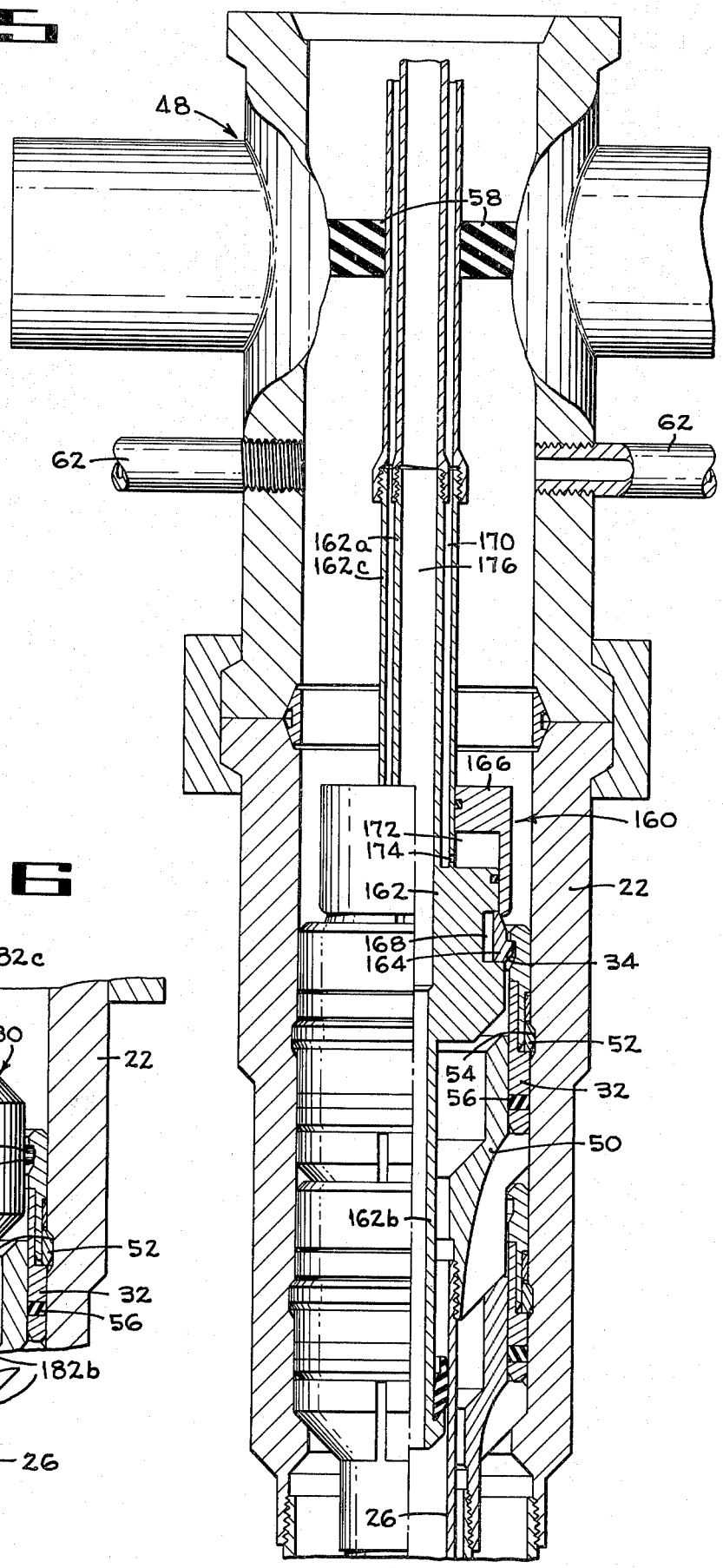
FIG. 5 is a view like FIG. 1, illustrating yet another embodiment of running and retrieving tool according to the present invention.

The running and retrieving tool 160 shown in FIG. 5 is a variation of the tool 10 of FIG. 1, the difference being in the arrangement for pressure-balancing. Like the tool 10, the tool 160 has a body 162 with an upper central tubular portion 162*a* and a lower central tubular portion 162*b*, a split contractible lock ring 164, and an annular piston 166 for retracting the lock ring into its groove 168. In addition, the tool body 162 has a second upper tubular portion 162*c* concentrically disposed around and spaced from the extension 162*a*, thereby defining an annulus 170 that is in communication with the chamber 172 between the piston 166 and the tool body 162 by means of one or more ports 174 (only one shown). The annulus 170 extends above the blowout preventer system 48 to vent the chamber 172 at a location above the preventer. Otherwise, the tool 160 functions in identical manner with the tool 10 of FIG. 1.

Figure 6:
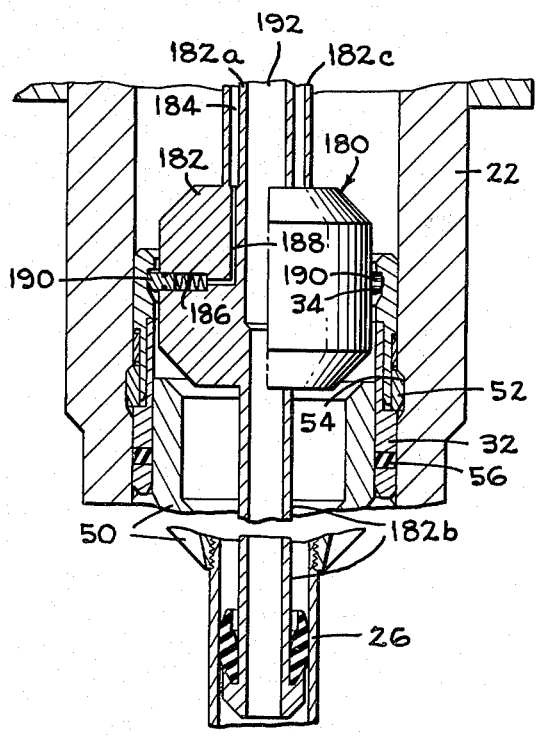
FIG. 6 is a view like FIG. 2, showing a modified version of the running and retrieving tool of FIG. 5.

FIG. 6 illustrates how the tool 160 of FIG. 5 can be modified by employing lock pistons instead of a lock ring. In FIG. 6, the tool 180 has a body 182, upper and lower central tubular portions 182*a*, 182*b*, an outer upper tubular portion 182*c* concentric with and spaced from the tubular portion 182*a*, and a pressure balancing annulus 184 communicating with lock piston chambers 186 (only one shown) by means of passages 188 (only one shown). A plurality of lock pistons 190 function like their counterparts in tools 100 (FIG. 2) and 140 (FIG. 4) to releasably interconnect the tool 180 with a packoff 32 or other well tool. If desired, the through bores 176,192 of the tools 160,180 can be closed in the respective tool bodies to provide yet another version of this apparatus similar to that illustrated in FIGS. 3 and 4.

Figure 7:
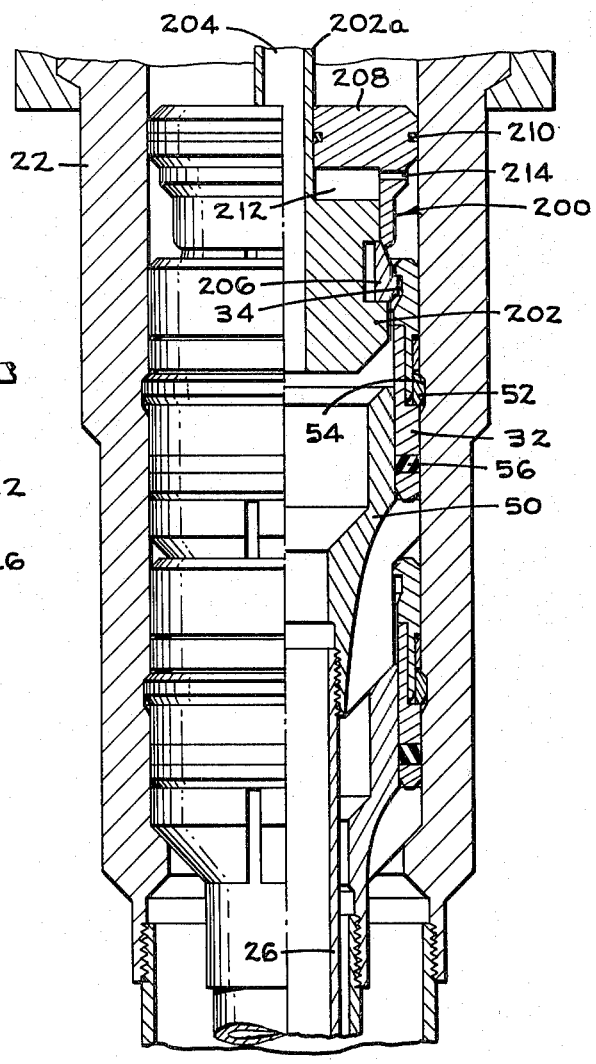
FIG. 7 is a fragmentary view similar to FIG. 1, illustrating still another embodiment of running and retrieving tool according to the present invention.

The running and retrieving tool 200 illustrated in FIG. 7 is similar to the tool 10 of FIG. 1, in that it has a body 202 with a single upper central tubular portion 202*a*, a through-bore 204, a split contractible lock ring 206, and an annular piston 208. However, in lieu of a lower central tubular body portion and a seal element corresponding to 12*b* and 24 of the tool 10, the piston 208 is provided with an annular dynamic seal 210 that functions as a pressure barrier between the piston and the wellhead 22. Furthermore, the annular chamber 212 between the piston 208 and the tool body 202 is vented to the wellhead below the seal 210 by one or more passages 214 (only one shown), thereby achieving pressure balancing to the tool bore 204 in slightly different manner than that employed in the tool 10. In other respects, the tools 200 and 10 function identically in response to being pressurized through the choke and kill lines 62 (FIG. 1) according to the present invention.

Figure 8:
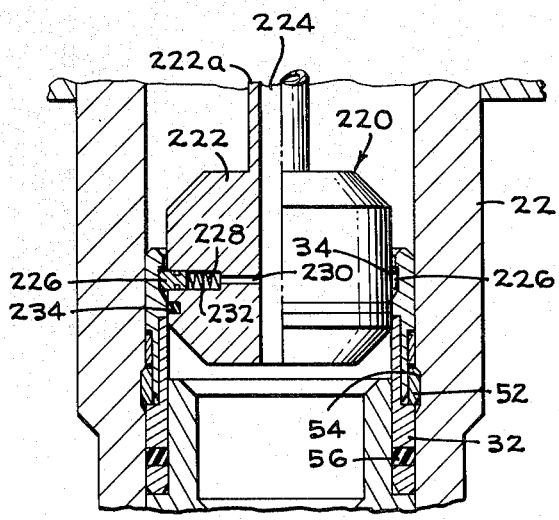
FIG. 8 is a view like FIG. 2, illustrating a modification of the running and retrieving tool of FIG. 7.

In FIG. 8 the running and retrieving tool 220 has a body 222 with a single upper central tubular portion 222*a*, a through bore 224, a plurality of hydraulically responsive lock pistons 226 biased outwardly of the tool body 222 by coil springs 228, and passages 230 (only one shown) providing communication between piston chambers 232 (only one shown) and the bore 224 for pressure balancing purposes. This tool 220 is sealed to the packoff 32, or other well tool to which it may be releasably connected by the lock pistons 226, by means of an annular seal element 234 residing in an external groove in the tool body 222 beneath the level of the lock pistons. As will be readily understood, this tool 220 operates in the same manner as the tools of FIGS. 2, 4 and 6 when subjected to pressure in the wellhead 22.

As should be evident, both tools 200 and 220 can be modified by closing their through bores 204,224, respectively, if such is desirable, without in any way changing their mode of operation.

Figure 9:
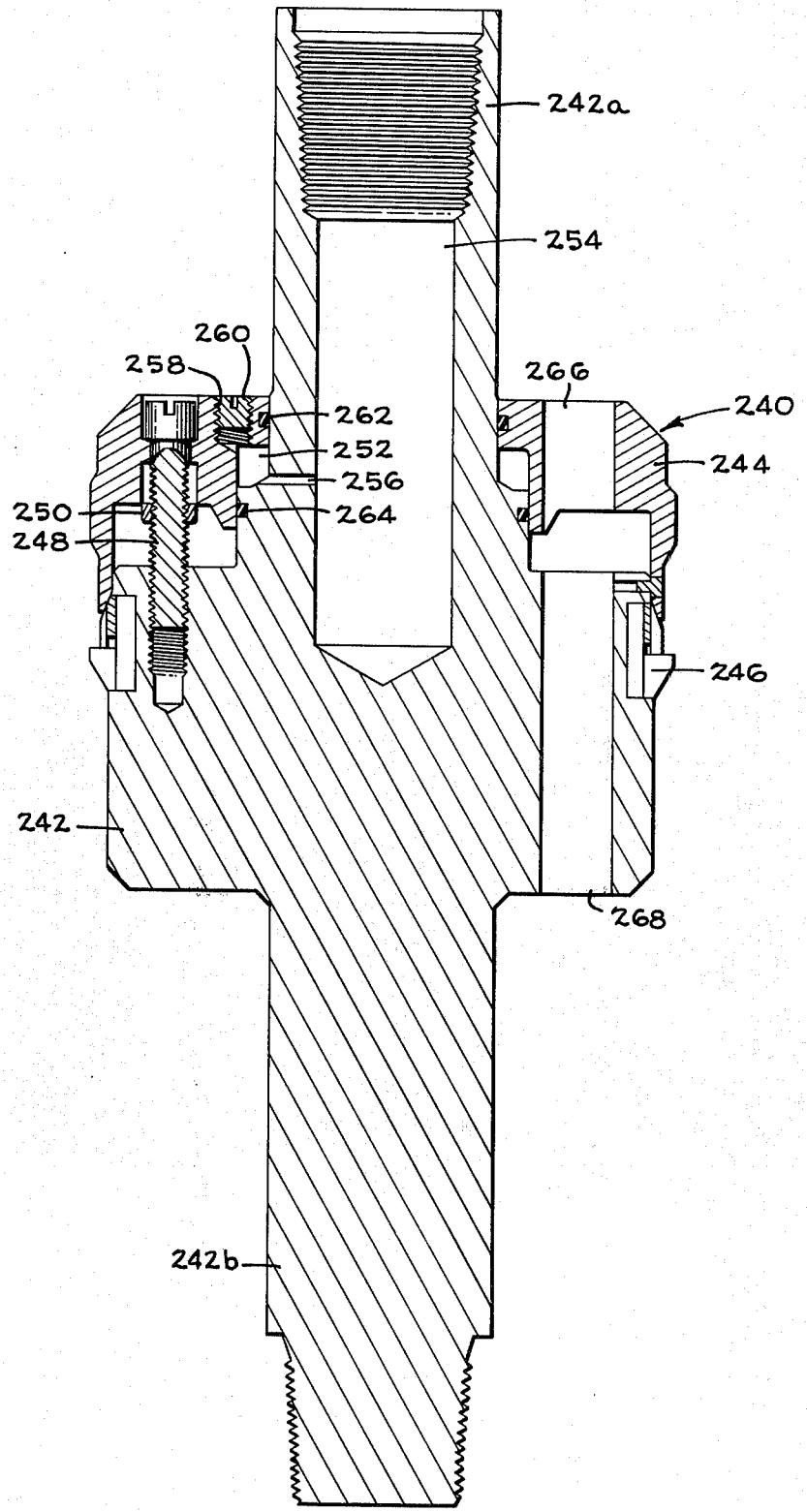
FIG. 9 is an elevation in central section, and on an enlarged scale, of another embodiment of running and retrieving tool according to the present invention.

The running and retrieving tool 240 illustrated in FIG. 9 is particularly suitable for running and/or retrieving bowl protectors in accordance with the present invention. This tool comprises a body 242 with an upper central tubular portion 242*a*, a lower central cylindrical portion 242*b* for supporting a seal element such as shown at 24 in FIG. 1, an annular piston 244, and a split contractible lock ring 246. The piston 244 is retained on the tool body 242 by one or more bolts 248 that project freely through the piston into threaded engagement with the tool body, and a retaining nut 250 that is non-rotatably secured to the bolt 248 by a set screw (not shown). The annular chamber 252 between the piston 244 and the tool body 242 is vented to the tool's central bore 254 by one or more passages 256

(only one shown) for pressure equalizing purposes, and a port 258 with a removable pipe plug 260 affords a means to flush out the chamber 252 when desired. The piston is dynamically sealed to the tool body by annular seal elements 262,264, and longitudinal passages 266 through the piston and 268 through the tool body provide a means to eliminate pressure build-up in the well as the tool 240 is being run or retrieved.

In operation, the tool 240 functions in like manner to the tool 120 of FIG. 3, the tool 240 of course being attached to a running string that is perforated or ported at a level above the blowout preventer system, as shown in FIG. 3.

One of the highly desirable advantages of this invention is that the use of choke and kill lines to conduct hydraulic pressure to the wellhead 22 for operating the running and retrieving tools described above eliminates the need for additional hydraulic lines that are cumbersome and easily damaged, that involve added equipment cost, and that usually require a separate power source. Furthermore, since choke and kill lines are normally present in a wellhead system during drilling, their use for this additional function requires no additional hook up time, thereby also achieving a significant financial saving over previous techniques that utilize a separate hydraulic system between the drilling platform or vessel and the wellhead.

Although the best mode contemplated for carrying out the present invention has been herein shown and described, it will be apparent that modification and variation may be made without departing from what is regarded to be the subject matter of the invention.

What is claimed is:

1. A method of releasing a running and retrieving tool connected to a pipe string from a well tool located in a well below a blowout preventer system, said well having a wellhead and at least one choke and kill line extending from said wellhead to a control station, comprising a. closing the blowout preventer system around the pipe string, b. conducting hydraulic pressure through the choke and kill line into the well to pressurize the well annulus below the blowout preventer system, and c. exerting the choke and kill line hydraulic pressure in the well annulus against pressure-responsive means on the running and retrieving tool to disengage said means from said well tool, thereby releasing said running and retrieving tool from said well tool for withdrawal by said pipe string from said well.

2. A method according to claim 1, wherein the running and retrieving tool is located in the wellhead.

3. A method according to claim 1, wherein the pressure-responsive means includes hydraulic piston means responsive to externally applied pressure for actuation.

4. A hydraulically actuated running and retrieving tool for use in running and retrieving well tools into and from a remotely located wellhead, said running and retrieving tool comprising a. a body, b. means on the body for attaching the tool to a drill pipe string, and c. means on the body for releasably connecting the running and retrieving tool to a well tool, said connecting means comprising external piston means mounted on the exterior of said body and linearly movable with respect thereto in response to external exertion of hydraulic pressure thereon, whereby exertion of said external hydraulic pressure actuates said external piston means and releases said running and retrieving tool from said well tool.

5. A running and retrieving tool according to claim 4, wherein the releasably connecting means comprises a split contractible lock ring.

6. A running and retrieving tool according to claim 4, wherein the releasably connecting means comprises at least one lock piston.

7. A running and retrieving tool according to claim 7, wherein the piston means comprises an annular external hydraulic piston sealed in fluid-tight manner to the body, and wherein the releasably connecting means comprises a split contractible lock ring, said lock ring contracting in response to application of said external hydraulic pressure to said external hydraulic piston.

8. A running and retrieving tool according to claim 4, wherein the releasably connecting means facilitates interconnecting said running and retrieving tool with a well tool in the absence of hydraulic pressure.

* * * * *

UNITED STATES PATENT AND TRADEMARK OFFICE

CERTIFICATE OF CORRECTION

PATENT NO. : 4,003,434

DATED : January 18, 1977

INVENTOR(S) : MICHAEL R. GARRETT et al

It is certified that error appears in the above-identified patent and that said Letters Patent are hereby corrected as shown below:

Column 1, line 34, change "apat" to --apart--.
Column 3, line 62, change "postion" to --position--.
Column 5, line 34, change "sprinng-biased" to --spring-biased--.
Column 8, line 36, after "claim" change the numeral "7" to --4--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*